United States Patent [19]

Leiner et al.

[11] 4,410,067

[45] Oct. 18, 1983

[54] ELEVATOR DOOR OPERATOR

[75] Inventors: Robert L. Leiner, Simsbury; John K. Salmon, South Windsor, both of Conn.

[73] Assignee: Otis Elevator Company, Farmington, Conn.

[21] Appl. No.: 307,391

[22] Filed: Sep. 30, 1981

[51] Int. Cl.[3] ..... B66B 13/12

[52] U.S. Cl. ..... 187/52 LC; 187/60

[58] Field of Search ..... 187/52 R, 52 LC, 56, 187/60; 49/61, 63, 118, 362

[56] References Cited

U.S. PATENT DOCUMENTS

| | | | |
|---|---|---|---|
| 1,269,927 | 6/1918 | Groat | 187/52 LC |
| 2,985,258 | 5/1961 | Kraft | 187/52 LC |
| 3,065,826 | 11/1962 | Tucker, Jr. | 187/52 LC |
| 3,638,762 | 2/1972 | Johns | 187/52 LC |

*Primary Examiner*—Joseph J. Rolla
*Assistant Examiner*—Russell D. Stormer
*Attorney, Agent, or Firm*—Robert E. Greenstien

[57] ABSTRACT

An elevator door operator includes a motor which drives a worm gear. This worm gear controls the motion of a block which contains retractable members that engage rollers on the hall door, and which engage a block which is connected to the car door. When the car doors are fully closed, these members are fully retracted.

8 Claims, 1 Drawing Figure

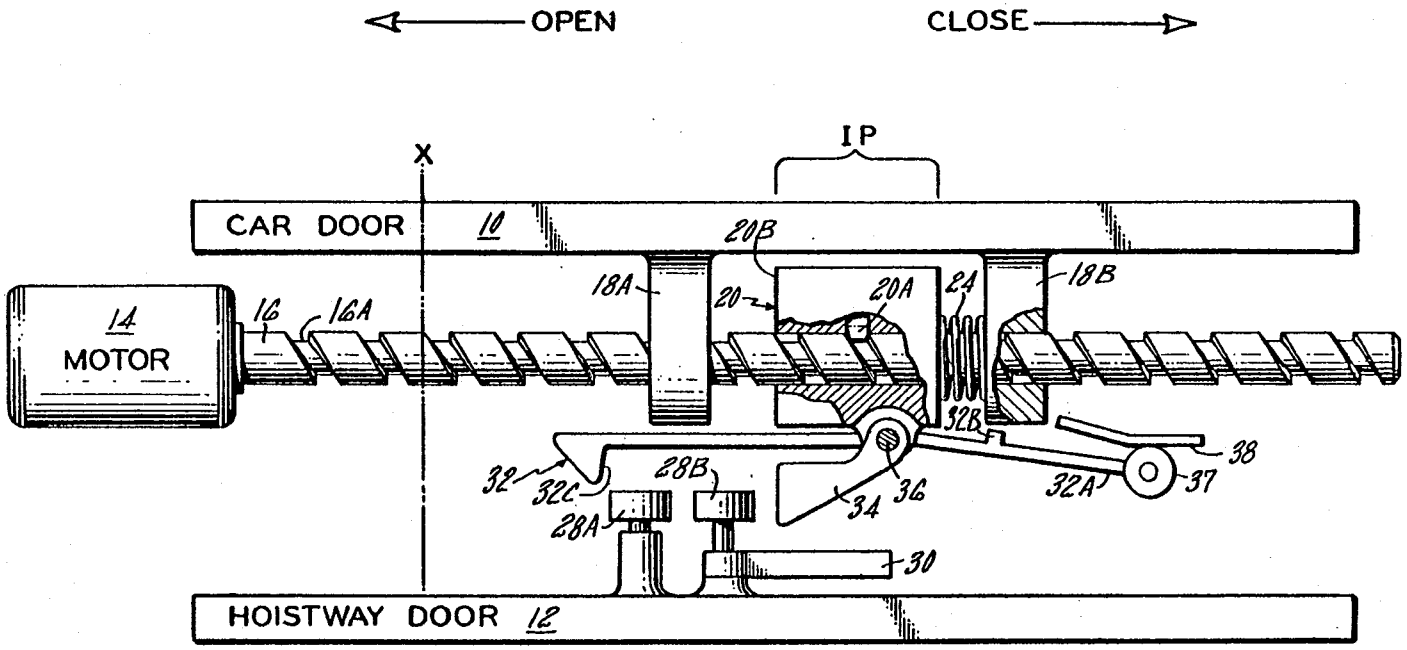
CLOSE
OPEN
IP
CAR DOOR
10
HOISTWAY DOOR
12
14
MOTOR
16
16A
18A
18B
20
20A
20B
24
28A
28B
30
32
32A
32B
32C
34
36
37
38
X

ELEVATOR DOOR OPERATOR

DESCRIPTION

1. Technical Field

This invention relates to elevator systems and, in particular, door operators to open and close the car and hall doors simultaneously.

2. Background Art

The vast majority of elevator systems have separate hall and car doors which open and close together. Typically, the elevator car carries a door drive, commonly known as a door operator, to open and close the car door, and the hall door is coupled to the car door so that it opens and closes with it. The hall door also includes an interlock apparatus that locks the hall door closed, except when it is opened by the motion of the car door, to prevent the occupants on the floor from gaining access to the shaftway.

U.S. Pat. No. 3,638,762 to Johns titled Door-Coupling Apparatus for Elevators shows a combined coupling apparatus and interlock arrangement. It includes a vane that is carried on the hall door and that fits between two roller assemblies on the hall door when the car is at the floor. As the car door opens, the vane movement includes the hall door and actuates a switch that inhibits car motion and pulls the hall door open. Similarly, as the car door closes, the motion of the vane causes the hall door to close.

There are some disadvantages with that arrangement. One is that the vane and roller must be carefully aligned for the vane to pass between the rollers as it stops at each floor. Another is that, because the vane extends from the car door, space must be provided between the shaftway walls and the car door for the vane, and that increases the required "running clearance".

DISCLOSURE OF THE INVENTION

An object of the present invention is to provide a system for opening and closing the car and hull doors.

According to the invention, the car and hall doors are opened and closed by a motor drive, and the connection between the drive unit and the doors is provided by a coupling assembly which is moved linearly by the drive unit in order to open and close the doors. As it moves from an initial position, when the doors are fully closed, the assembly is connected to the two doors, thereby connecting the doors to the drive unit. This coupling assembly includes at least one arm which is retracted when the coupling assembly is in that initial position, and when the coupling assembly moves from that position, this arm extends towards the doors to a position at which it can engage them as the assembly continues to move.

The invention consequently provides a combined car door operator and door coupling apparatus characterized in that the car and hall doors are only connected to the drive unit and each other as they are opening and closing, and, when the doors are fully closed, they are completely unattached from each other and from the drive unit. The doors therefore always operate together, regardless of the running clearance between the coupling assembly and the doors.

Objects, benefits and features of the invention will be apparent to one skilled in the art from the following detailed description of an exemplary embodiment thereof, as illustrated in the accompanying drawing.

BRIEF DESCRIPTION OF THE DRAWING

The drawing is a top plan view of a car door, hoistway door and door operator apparatus according to the present invention.

BEST MODE FOR CARRYING OUT THE INVENTION

Referring to the drawing, a car door 10, part of the elevator cab, and a hall door 12 are shown, as seen from above, looking down the elevator shaft at the area between the cab and the hall door at a floor. For convenience, these are single, side opening doors, but they may also be one door of a center opening door system comprising two doors that are mechanically connected so that as one opens in one direction, the other opens in the opposite direction. The two doors slide or roll on parallel paths to open and close. They are powered to open and close by a drive unit comprising a motor 14 which rotates an endless worm gear or screw 16 that extends parallel to the doors. The drive unit is located between the cab and the hoistway wall and above the doors in the header area, where it may be supported by brackets and bearing supports, which, in as much as they are well known, have not been shown. The screw 16 passes through, but is not connected to, two guide posts 18A and 18B that are attached to or part of the car door 10 which may therefore slide on the screw as it opens and closes. A door coupling assembly 20 is located between the doors on the screw, and it includes a follower 20A which connects the assembly to the screw groove 16A. Therefore, the assembly is mechanically connected to the screw and, as the screw turns, it moves either left or right, depending on the direction in which the screw rotates. In addition to being located between the doors, the door coupling apparatus also is located between the guide posts 18A and 18B. The door coupling apparatus includes a block 20B which strikes the guide post 18A as the assembly 20 is moved to the left and, in this way, the car door is pushed open, and, as described in more detail later herein, the hall door is also connected to the assembly and the two doors thereby open and close together as the assembly, i.e. the block 20B, moves left and right. The assembly 20 is in an "initial" position (see bracket IP) in the drawing, at which both doors are fully closed, and in this position, it should be noticed, the car door may be moved back and forth, so to speak, on either side of the assembly 20. In this position the block 20B is not in contact with either guide post, nor the hall door. A spring 24 does separate the block 20B and guide post 18B to "push" on post 18A, and thus push the door to the right, which aids in closing the car door when the coupling assembly is in the initial position - which is as far as it can go to the right.

Shifting observation now to the hoistway door 12, it contains two rollers 28A and 28B which are functionally the same as the rollers shown in the previously mentioned patent to Johns. The roller 28B is eccentrically mounted on the hall door and can move (rotate) in order to move to the left without the hall door moving at all. The roller 28B is connected to an arm 30 which is connected to a control apparatus (being well known, it is not shown). The control apparatus is connected to the car motion controller and is operated by the motion of the roller, as it moves to the left, to prevent the car from moving. A similar "interlock" is shown in the patent to Johns.

The door coupling assembly 20 is connected to the hall door 12 through these rollers as it (the assembly) is moved to the left. To do so, it has two arms or clamps 32, 34 which connect the assembly 20 to the rollers during that motion. Both are pivotally attached to the block 20B on a post 36, but a spring (not visible) that is located around the post 36 engages the arm 32 to bias it in the counterclockwise (CCW) direction and the arm 34 in the position shown in the drawing. Due to the spring, the arm 34 can slide over the rollers, if necessary, to move to the right. It, however, positively engages roller 28B as it moves in the opposite direction. A roller 37 is attached on one end 32A of the arm 32 and rides on an arm control surface 38. This surface 38 is stationary relative to the assembly 20. On the same side of the arm 32 is an extension or protrusion 32B, which engages the guide post 18B when the arm rotates CCW, as explained later. The opposite end 32C of the arm 32 is cammed or latch shaped and grabs the left side of the roller 28A as the arm 32 rotates CCW. The control surface or cam 38 controls the position of the arm 32 as a function of the position of the assembly 20. As the assembly 20 moves to the left (to open the doors), the arm 32, under the pressure of the spring, follows the surface and thereby rotates around the post 36 in the CCW direction. Thus, the end 32C moves towards the hall door and the protrusion 32B moves, at the same time, towards the car door. During this sequence, the other arm 34 strikes the roller 28B, pushing it towards the roller 28A, and moving the arm 30 to the left (which actuates the interlock). The roller 28B may strike the roller 28A or a stop, and then, as the assembly 20 continues to move to the left, the hall door starts to open. At the same time that the arm 32 rotates so that the end 32C is just to the left of the roller 28A, the protrusion 32C rotates towards the car door to be just to the left of guide post 18B, and the block 20A thereby strikes the guide post 18A, and the car door thus starts to open. As the assembly continues to move to the left, both doors thereby open, and when they are fully open, the motor is stopped.

Assuming the doors are fully open, the block 20A will be to the left, at an assumed position X, at which the doors are open. To close the doors, the motor is reversed, causing the block 20A to move to the right from position X. The mechanical connection between the hoistway door and the block is now provided by the end 32C, which now pulls on the roller 28A in order to pull the car hoistway door closed, and, during this closing operation, the mechanical connection between the car door and the block 20A is provided by the protrusion 32B, which pushes on the guide arm 18B. As the block moves from position X, the roller 36 eventually strikes the control cam 38, and as it rides upon it, as it moves to the right, the arm 32 rotates clockwise and eventually is retracted, as shown in the drawing, when the assembly 20 reaches the initial position again - where the doors are disconnected from the block, from each other and the motor 14. The spring 24 is included simply to provide an additional thrust or bias to close the car door even after the motor 14 has stopped; it may be excluded.

These are, of course, variations in this system. For instance, rather than using a single arm 32 to engage both doors, a separate arm could be used for each and controlled separately by a stationary control surface or cam. Other related modifications are, of course, possible.

A notable characteristic of this system is this: when both doors are fully closed and the coupling assembly 20 is at the initial position, the doors are completely disconnected from each other and also from the motor 14. And, equally significant, unlike other door operators, the car door and hoistway door will always open and close together - because the mechanical connection between the two occurs simultaneously with the motion of the door coupling assembly 20. Regardless of where the position block 20A is when the doors are closed, it will simultaneously connect to the car door and hoistway door as it is moved to the left, and, thus, the distance between the roller 28B and the arm 34, which reflects the relative position of the block 20A, when the doors are fully closed, is virtually immaterial; regardless of that distance, the doors will always open and close together.

It should be understood by those skilled in the art that, in addition to those mentioned, other various changes, omissions and additions may be made to the exemplary embodiment shown and described above without departing from the true scope and spirit of the invention embodied therein.

We claim:

1. Apparatus characterized by:

a pair of parallel sliding doors, a motor-powered drive unit to open and close the doors, a coupling assembly which connects the doors to the drive unit, said assembly being propelled by the drive unit between a first position at which the doors are opened and a second position at which the doors are closed, said assembly including a block-like member which, as the assembly moves in one direction, pushes one door in that direction, a first arm on the block-like member for pushing the second door in that one direction, a second arm on said block-like member for grabbing each door as the block-like member is moved in a second direction, opposite the first direction, said second arm being retractable to disengage its connection with both doors when the assembly is at the first position, and a control surface, stationary relative to the assembly, for controlling the second arm as the assembly moves to said second position and causing the second arm to retract to the disengaged position.

2. Apparatus according to claim 1, characterized by:

two spaced-apart posts that are located on the one door, the block-like member being located between the two posts for pushing on one post to move the door in a first direction, and the second retractable arm being located for pushing on the other post to move the door in the second direction.

3. Apparatus according to claim 2, characterized by:

a pair of rollers being located on the second door, the first arm being located for pushing on one of these rollers to move the second door in the one direction, the second arm being located for grabbing the other roller to pull the second door in the second direction, the second arm being spring-biased to a position for engaging the first roller as the assembly moves in the first direction, and a spring located between the block-like member and one of the posts to urge the one door in the second direction.

4. An apparatus characterized by:

a pair of parallel sliding doors, a motor-powered drive unit to open and close the doors, a coupling assembly which connects the doors to the drive unit, said assembly being propelled by the drive unit between a first position at which the doors are opened and a second position at which the doors are closed, said assembly including a block-like member which, as the assembly moves in one direction, pushes one door in that direction, a first arm on the block-like member for pushing the second door in that one direction, a second arm on said block-like member for grabbing each door as the block-like member is moved in a second direction, opposite the first direction, said second arm being retractable to disengage its connection with both doors when the assembly is at the first position, a control surface, stationary relative to the assembly, for controlling the second arm as the assembly moves to said second position and causing the second arm to retract to the disengaged position, two spaced-apart posts that are located on the one door, the block-like member being located between the two posts for pushing on one post to move the door in a first direction, the second retractable arm being located for pushing on the other post to move the door in the second direction, a pair of rollers being located on the second door, the first arm being located for pushing on one of these rollers to move the second door in the one direction, the second arm being located for grabbing the other roller to pull the second door in the second direction, the second arm being spring-biased to a position for engaging the first roller as the assembly moves in the first direction, and a spring located between the block-like member and one of the posts to urge the one door in the second direction.

5. Apparatus for opening and closing a pair of parallel sliding doors, characterized by:

a motor-powered drive unit to open and close the doors, a coupling assembly which connects the doors to the drive unit, said assembly being propelled by the drive unit between a first position at which the doors are opened and a second position at which the doors are closed, said assembly including a block-like member which, as the assembly moves in one direction, pushes one door in that direction, a first arm on the block-like member for pushing the second door in that one direction, a second arm on said block-like member for grabbing each door as the block-like member is moved in a second direction, opposite the first direction, said second arm being retractable to disengage its connection with both doors when the assembly is at the first position, and a control surface, stationary relative to the assembly, for controlling the second arm as the assembly moves to said second position and causing the second arm to retract to the disengaged position.

6. Apparatus according to claim 5, characterized by:

two spaced-apart posts that are located on the one door, the block-like member being located between the two posts for pushing on one post to move the door in a first direction, and the second retractable arm being located for pushing on the other post to move the door in the second direction.

7. Apparatus according to claim 6, characterized by:

a pair of rollers being located on the second door, the first arm being located for pushing on one of these rollers to move the second door in the one direction, the second arm being located for grabbing the other roller to pull the second door in the second direction, the second arm being spring-biased to a position for engaging the first roller as the assembly moves in the first direction, and a spring located between the block-like member and one of the posts to urge the one door in the second direction.

8. Apparatus for opening and closing a pair of parallel sliding doors, characterized by:

a motor-powered drive unit to open and close the doors, a coupling assembly which connects the doors to the drive unit, said assembly being propelled by the drive unit between a first position at which the doors are opened and a second position at which the doors are closed, said assembly including a block-like member which, as the assembly moves in one direction, pushes one door in that direction, a first arm on the block-like member for pushing the second door in that one direction, a second arm on said block-like member for grabbing each door as the block-like member is moved in a second direction, opposite the first direction, said second arm being retractable to disengage its connection with both doors when the assembly is at the first position, a control surface, stationary relative to the assembly, for controlling the second arm as the assembly moves to said second position and causing the second arm to retract to the disengaged position, two spaced-apart posts that are located on the one door, the block-like member being located between the two posts for pushing on one post to move the door in a first direction, the second retractable arm being located for pushing on the other post to move the door in the second direction, a pair of rollers being located on the second door, the first arm being located for pushing on one of these rollers to move the second door in the one direction, the second arm being located for grabbing the other roller to pull the second door in the second direction, the second arm being spring-biased to a position for engaging the first roller as the assembly moves in the first direction, and a spring located between the block-like member and one of the posts to urge the one door in the second direction.

* * * * *